US009905214B2

(12) United States Patent
Schroeder et al.

(10) Patent No.: US 9,905,214 B2
(45) Date of Patent: Feb. 27, 2018

(54) EXTRUDED SONAR CHASSIS

(71) Applicant: Navico Holding AS, Egersund (NO)

(72) Inventors: Jeremy Schroeder, Sapulpa, OK (US); Blessing Anna Williams, Tulsa, OK (US)

(73) Assignee: NAVICO HOLDING AS, Egersund (NO)

( * ) Notice: Subject to any disclaimer, the term of this patent is extended or adjusted under 35 U.S.C. 154(b) by 359 days.

(21) Appl. No.: 14/718,059

(22) Filed: May 20, 2015

(65) Prior Publication Data

US 2016/0343365 A1 Nov. 24, 2016

(51) Int. Cl.

| | |
|---|---|
| ***G10K 11/20*** | (2006.01) |
| ***B21C 23/21*** | (2006.01) |
| ***G10K 11/00*** | (2006.01) |
| ***B21C 23/14*** | (2006.01) |

(52) U.S. Cl.

CPC ..... *G10K 11/006* (2013.01); *B21C 23/142* (2013.01)

(58) Field of Classification Search

CPC .. G10K 11/006; G10K 11/205; B21C 23/142; B21C 23/212

See application file for complete search history.

(56) References Cited

U.S. PATENT DOCUMENTS

| | | | | |
|---|---|---|---|---|
| 5,047,996 | A * | 9/1991 | Armiger | G10K 11/008 367/154 |
| 2002/0159336 | A1* | 10/2002 | Brown | B06B 1/0633 367/138 |
| 2012/0113757 | A1* | 5/2012 | Kurpiewski | G10K 11/006 367/173 |
| 2015/0294660 | A1* | 10/2015 | Stokes | G01S 15/96 367/173 |
| 2016/0343365 | A1* | 11/2016 | Schroeder | G10K 11/006 |

* cited by examiner

*Primary Examiner* — Daniel Pihulic

(74) *Attorney, Agent, or Firm* — Nelson Mullins Riley & Scarborough LLP

(57) ABSTRACT

An aluminum transducer chassis prepared by a process having the following steps: performing an extrusion using a die and an aluminum billet to create an extruded chassis, wherein the die has a cross sectional shape of the transducer chassis; and cutting the extruded chassis to a plurality of predetermined lengths, each length corresponding to the length of a transducer chassis.

19 Claims, 2 Drawing Sheets

EXTRUDED SONAR CHASSIS

BACKGROUND

This section is intended to provide background information to facilitate a better understanding of various technologies described herein. As the section's title implies, this is a discussion of related art. That such art is related in no way implies that it is prior art. The related art may or may not be prior art. It should therefore be understood that the statements in this section are to be read in this light, and not as admissions of prior art.

Operators of marine vessels may use instruments to map the water and underwater terrain in the vicinity of the marine vessel, and to detect fish or objects in the water. One or more sonar transducer arrays may be used to map the water and underwater terrain. The map of the underwater terrain within the vicinity of the vessel may be used for navigation purposes, to detect fish, to determine areas or depths to fish, or for other purposes.

SUMMARY

Various implementations described herein are directed to a method that includes the following steps: creating a die with a cross sectional shape of a transducer chassis, performing an extrusion using the die and an aluminum billet to create an extruded chassis, and cutting the extruded chassis to a plurality of predetermined lengths, each length corresponds to a length of the transducer chassis.

Various implementations described herein are also directed to an aluminum transducer chassis prepared by a process having the following steps: performing an extrusion using a die and an aluminum billet to create an extruded chassis, wherein the die has a cross sectional shape of the transducer chassis; and cutting the extruded chassis to a plurality of predetermined lengths, each length corresponding to the length of a transducer chassis.

Various implementations described herein are also directed to a sonar transducer having: an aluminum transducer chassis created using an extrusion process, one or more sonar transducer arrays attached to the transducer chassis, and a bracket configured to couple the transducer chassis to the hull of a marine vessel.

BRIEF DESCRIPTION OF THE DRAWINGS

Implementations of various technologies will hereafter be described with reference to the accompanying drawings. It should be understood, however, that the accompanying drawings illustrate only the various implementations described herein and are not meant to limit the scope of various technologies described herein.

DETAILED DESCRIPTION

Various implementations of a transducer chassis will now be described in more detail with reference to FIGS. 1-4.

Figure 1:
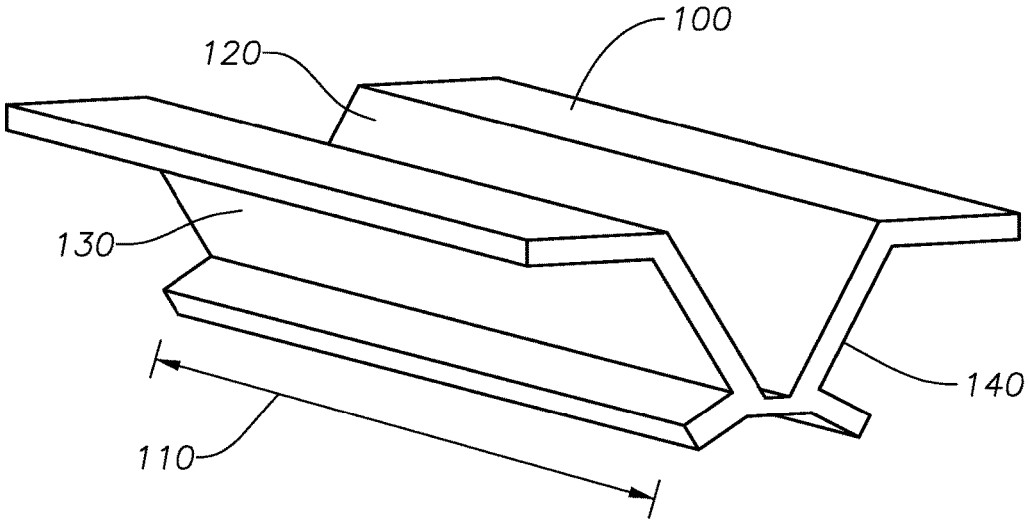
FIG. 1 illustrates a transducer chassis in accordance with implementations of various techniques described herein.

FIG. 1 illustrates a transducer chassis 100 in accordance with implementations of various techniques described herein. The transducer chassis 100 may hold one or more sonar transducer arrays. For example, a first transducer array may be mounted to the wall 130 and a second transducer array may be mounted to the wall 140. The transducer chassis 100 may act as an electric or acoustic shield for the transducer arrays. The transducer chassis 100 may be coupled to the bottom of a marine vessel, i.e., to the hull.

In one implementation, the transducer chassis 100 may be placed in a plastic enclosure and attached to the bottom of a marine vessel. In another implementation, the transducer chassis 100 may be suspended in a urethane mold and attached to the bottom of a vessel. The transducer chassis 100 has a length 110. For example, the length 110 may range between about 190 mm and 210 mm.

The transducer chassis 100 has a space 120 between walls 130 and 140. The space 120 may hold cables or wires, a printed circuit board (PCB), or other sonar components. For example, the PCB may be connected via wires to transducer arrays mounted to the transducer chassis 100.

Figure 3:
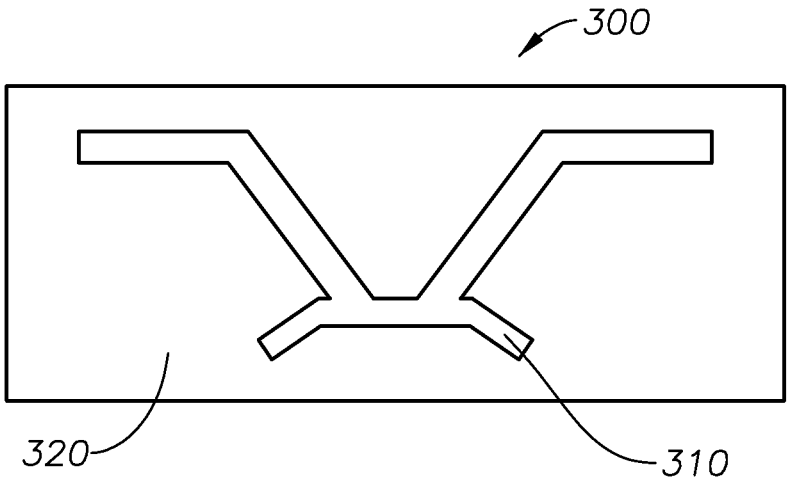
FIG. 3 illustrates an extrusion die for a transducer chassis in accordance with implementations of various techniques described herein.

The transducer chassis 100 may be created using an aluminum extrusion process. In the aluminum extrusion process, soft but solid aluminum, referred to as a billet, may be pushed or crushed through a die to create an extruded chassis. FIG. 3 illustrates an example of a die that may be used to produce the transducer chassis 100. The output of the die is a long piece, or an extruded chassis, with the cross section of the transducer chassis 100 and a length that is longer than the transducer chassis 100. The extruded chassis may then be cut to a set length, thereby forming the transducer chassis 100. Producing the transducer chassis 100 using an aluminum extrusion process may be cheaper than producing the transducer chassis 100 using a die casting process. For example, the tooling cost or piece part price may be reduced.

Figure 2:
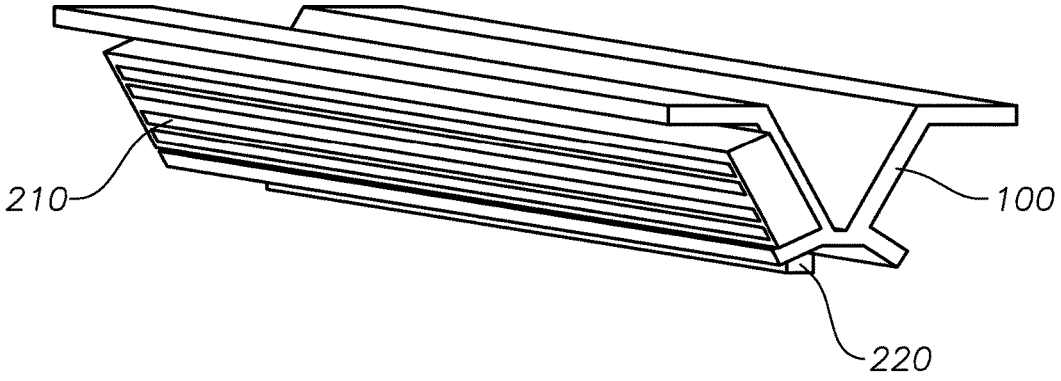
FIG. 2 illustrates a transducer chassis with sonar transducer arrays in accordance with implementations of various techniques described herein.

FIG. 2 illustrates a transducer chassis 100 having sonar transducer arrays disposed thereon in accordance with implementations of various techniques described herein. A side scan transducer array 210 may be attached to the transducer chassis 100. A second side scan transducer array 210 (not illustrated in FIG. 2) may be attached to the opposite side of the transducer chassis 100. In one implementation, the side scan transducer array 210 may be about 206 mm long and about 10.8 mm thick. The side scan transducer array 210 may have one or more elements. For example, the side scan transducer array 210 may have four elements.

A down scan transducer array 220 may be located on the bottom of the transducer chassis 100. The down scan transducer array 220 may be a single element transducer array.

The transducer arrays 210 and 220 may be electrically shielded by the transducer chassis 100. The transducer arrays 210 and 220 may be fragile, and as such, the transducer chassis 100 may serve to protect the transducer arrays 210 and 220. For example, the transducer chassis 100 may protect the transducer array 210 and 220 from vibrations.

FIG. 3 illustrates an extrusion die 300 for a transducer chassis in accordance with implementations of various techniques described herein. The extrusion die 300 may be placed in a press to create a transducer chassis 100.

Figure 4:
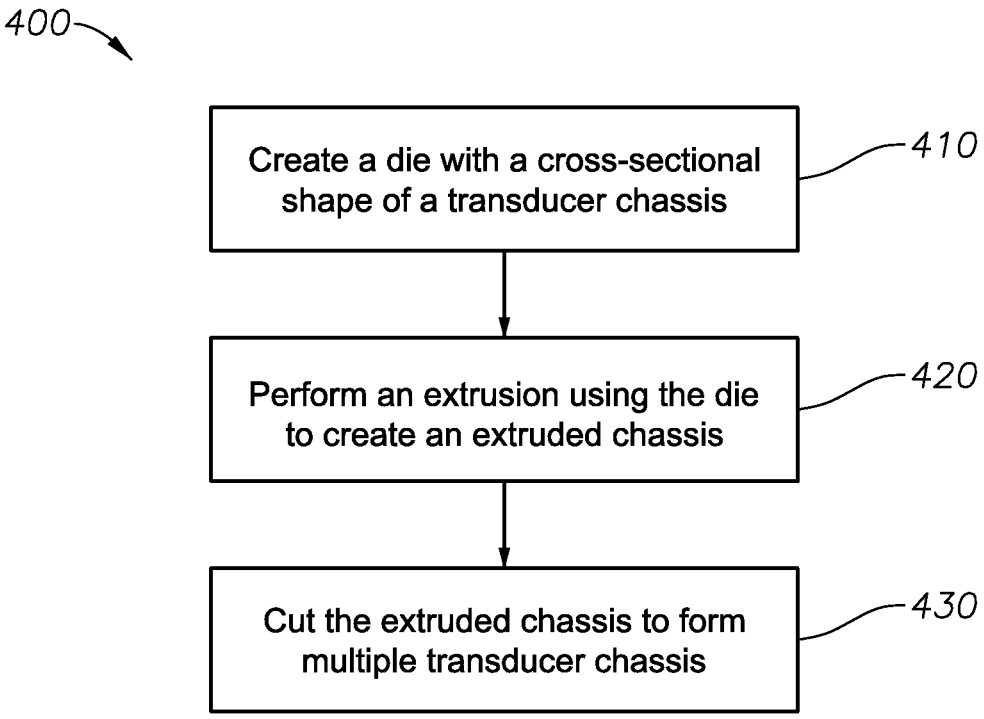
FIG. 4 illustrates a method for creating a transducer chassis in accordance with implementations of various techniques described herein.

FIG. 4 illustrates a method 400 for creating a transducer chassis in accordance with implementations of various techniques described herein. It should be understood that while method 400 indicates a particular order of execution of operations, in some implementations, certain portions of the operations might be executed in a different order. Further, in some implementations, additional operations or steps may be added to the method 400. Likewise, some operations or steps may be omitted.

At block 410, the die 300 with the cross sectional shape of the transducer chassis 100 may be produced.

At block 420, an aluminum extrusion may be performed using the die 300 to create an extruded chassis. During the extrusion process, an aluminum billet may pass through section 310 of the die 300, which is a cutout, and emerge from the die 300 as an extruded chassis with a cross section having the shape of section 310. The aluminum may not pass through section 320 of the die 300.

At block 430, the extruded chassis may be cut to form multiple transducer chassis 100. For example, an automatic saw may be configured to saw the extruded chassis into multiple transducer chassis 100 with a set length. The transducer chassis 100 may be configured to one or more arrays or elements. For instance, the transducer chassis 100 may hold two side scan sonar transducer arrays and one down scan sonar transducer array. As another example, the transducer chassis 100 may be configured to hold just one array, or even just one element. The mass of the aluminum billet may determine the length of the extruded chassis and the number of transducer chassis 100 that can be formed by cutting the extruded chassis.

It is to be understood that the discussion above is only for the purpose of enabling a person with ordinary skill in the art to make and use any subject matter defined now or later by the patent "claims" found in any issued patent herein.

It is specifically intended that the claimed invention not be limited to the implementations and illustrations contained herein, but include modified forms of those implementations including portions of the implementations and combinations of elements of different implementations as come within the scope of the following claims. Nothing in this application is considered critical or essential to the claimed invention unless explicitly indicated as being "critical" or "essential."

Reference has been made in detail to various implementations, examples of which are illustrated in the accompanying drawings and figures. In the detailed description, numerous specific details are set forth in order to provide a thorough understanding of the present disclosure. However, it should be apparent to one of ordinary skill in the art that the present disclosure may be practiced without these specific details. In other instances, well-known methods, procedures, components, circuits and networks have not been described in detail so as not to unnecessarily obscure aspects of the implementations.

It will also be understood that, although the terms first, second, etc. may be used herein to describe various elements, these elements should not be limited by these terms. These terms are only used to distinguish one element from another. For example, a first object or step could be termed a second object or step, and, similarly, a second object or step could be termed a first object or step, without departing from the scope of the invention. The first object or step, and the second object or step, are both objects or steps, respectively, but they are not to be considered the same object or step.

The terminology used in the description of the present disclosure herein is for the purpose of describing particular implementations only and is not intended to be limiting of the present disclosure. As used in the description of the present disclosure and the appended claims, the singular forms "a," "an" and "the" are intended to include the plural forms as well, unless the context clearly indicates otherwise. It should also be understood that the term "and/or" as used herein refers to and encompasses any and all possible combinations of one or more of the associated listed items. It should be further understood that the terms "includes," "including," "comprises" and/or "comprising," when used in this specification, specify the presence of stated features, integers, steps, operations, elements, and/or components, but should not preclude the presence or addition of one or more other features, integers, steps, operations, elements, components and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

"Alternatively" should not be construed to only pertain to situations where the number of choices involved is exactly two, but rather refers to another possibility among many other possibilities.

While the foregoing is directed to implementations of various techniques described herein, other and further implementations may be devised without departing from the basic scope thereof, which may be determined by the claims that follow.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method, the method comprising:

creating a die with a cross sectional shape of a transducer chassis, wherein the cross sectional shape of the transducer chassis defines at least a first slot, a second slot, and a third slot, wherein the first slot is structured to receive at least one generally down facing transducer element, wherein the second slot is structured to receive at least one generally side facing transducer element, and wherein the third slot is structure to receive at least one generally side facing transducer element, wherein the second slot is oriented toward a first side of the transducer chassis and the third slot is oriented toward a second opposite side of the transducer chassis;

performing an extrusion using the die and an aluminum billet to create an extruded chassis; and cutting the extruded chassis to a plurality of predetermined lengths, each length corresponds to a length of the transducer chassis.

2. The method of claim 1, wherein the transducer chassis is configured to act as an electric or acoustic shield.

3. The method of claim 1, wherein the extruded chassis is cut using an automatic saw.

4. The method of claim 1, wherein the mass of the aluminum billet is configured such that the extruded chassis is configured to hold at least three or more transducer arrays.

5. The method of claim 1, wherein the extruded chassis is configured to hold cables or a printed circuit board.

6. The method of claim 1, further comprising coupling the transducer chassis to a urethane or plastic bracket.

7. The method of claim 6, wherein the urethane or plastic bracket is configured to be attached to the bottom of a marine vessel.

8. An aluminum transducer chassis prepared by a process comprising the steps of:

performing an extrusion using a die and an aluminum billet to create an extruded chassis, wherein the die has a cross sectional shape of the transducer chassis, wherein the cross sectional shape of the transducer chassis defines at least a first slot, a second slot, and a third slot, wherein the first slot is structured to receive at least one generally down facing transducer element, wherein the second slot is structured to receive at least one generally side facing transducer element, and wherein the third slot is structure to receive at least one generally side facing transducer element, wherein the second slot is oriented toward a first side of the transducer chassis and the third slot is oriented toward a second opposite side of the transducer chassis; and cutting the extruded chassis to a plurality of predetermined lengths, each length corresponding to the length of a transducer chassis.

9. The transducer chassis of claim 8, wherein the transducer chassis is configured to act as an electric or acoustic shield.

10. The transducer chassis of claim 8, wherein the transducer chassis is configured to hold three or more sonar transducer arrays.

11. The transducer chassis of claim 8, wherein the transducer chassis is configured to hold two side scan transducer arrays and one down scan transducer array.

12. The transducer chassis of claim 8, wherein the transducer chassis has a space for cables or a printed circuit board.

13. The transducer chassis of claim 8, wherein the transducer chassis is configured to be coupled to a urethane or plastic bracket.

14. A sonar transducer, the sonar transducer comprising:

an aluminum transducer chassis created using an extrusion process, wherein the transducer chassis defines a cross sectional shape, wherein the cross sectional shape of the transducer chassis defines at least a first slot, a second slot, and a third slot, wherein the first slot is structured to receive at least one generally down facing transducer element, wherein the second slot is structured to receive at least one generally side facing transducer element, and wherein the third slot is structure to receive at least one generally side facing transducer element, wherein the second slot is oriented toward a first side of the transducer chassis and the third slot is oriented toward a second opposite side of the transducer chassis;

one or more sonar transducer elements attached to the transducer chassis in at least one of the first slot, the second slot, or the third slot; and a bracket configured to couple the transducer chassis to the hull of a marine vessel.

15. The sonar transducer of claim 14, wherein the bracket is a plastic or urethane bracket.

16. The sonar transducer of claim 14, wherein the one or more sonar transducer arrays comprise two side scan sonar transducer arrays and one downscan sonar transducer array.

17. The sonar transducer of claim 14, wherein the transducer chassis is configured to hold cables or a printed circuit board (PCB).

18. The sonar transducer of claim 14, further comprising a printed circuit board (PCB) coupled to the transducer arrays.

19. The sonar transducer of claim 14, wherein the aluminum transducer chassis is cut from an extruded chassis.

* * * * *